US007122013B2

(12) United States Patent
Liu

(10) Patent No.: US 7,122,013 B2
(45) Date of Patent: Oct. 17, 2006

(54) EYES MASSAGE DEVICE

(76) Inventor: Hsing Chuan Liu, 5F., No. 206-4, Dadun 7th St., Nantun District, Taichung City (TW)

( * ) Notice: Subject to any disclaimer, the term of this patent is extended or adjusted under 35 U.S.C. 154(b) by 26 days.

(21) Appl. No.: 11/080,600

(22) Filed: Mar. 14, 2005

(65) Prior Publication Data

US 2006/0206041 A1 Sep. 14, 2006

(51) Int. Cl.
*A61H 9/00* (2006.01)
*A61H 23/04* (2006.01)

(52) U.S. Cl. ..... 601/13; 601/9; 601/11

(58) Field of Classification Search ..... 601/6, 601/7, 9–11, 13, 154–169; 604/294
See application file for complete search history.

(56) References Cited

U.S. PATENT DOCUMENTS 2,114,407 A * 4/1938 Tsumura ..... 601/37
2,612,892 A * 10/1952 Beatman ..... 601/160
4,387,707 A * 6/1983 Polikoff ..... 601/37

* cited by examiner

*Primary Examiner*—Danton Demille
*Assistant Examiner*—Manuj Agarwal
(74) *Attorney, Agent, or Firm*—Pro-Techtor Int'l Services

(57) ABSTRACT

Provided is a device for massaging eyes comprising a mask received in a compartment and comprising annular left and right guards surrounding rear portions of left and right eye portions respectively, and left and right diaphragms in the eye portions respectively; a pneumatic-powered cylinder assembly for converting rotating motion into reciprocating motion; and a plastic tube interconnected the mask and the cylinder assembly. In operation, air having positive or negative pressure is built in the cylinder alternately prior to communicating to the eyes for massaging. There are provided protrusions around a rear portion of each guard. In another embodiment, there are provided left and right soft spacers attached to rear surfaces of the diaphragms respectively.

5 Claims, 9 Drawing Sheets

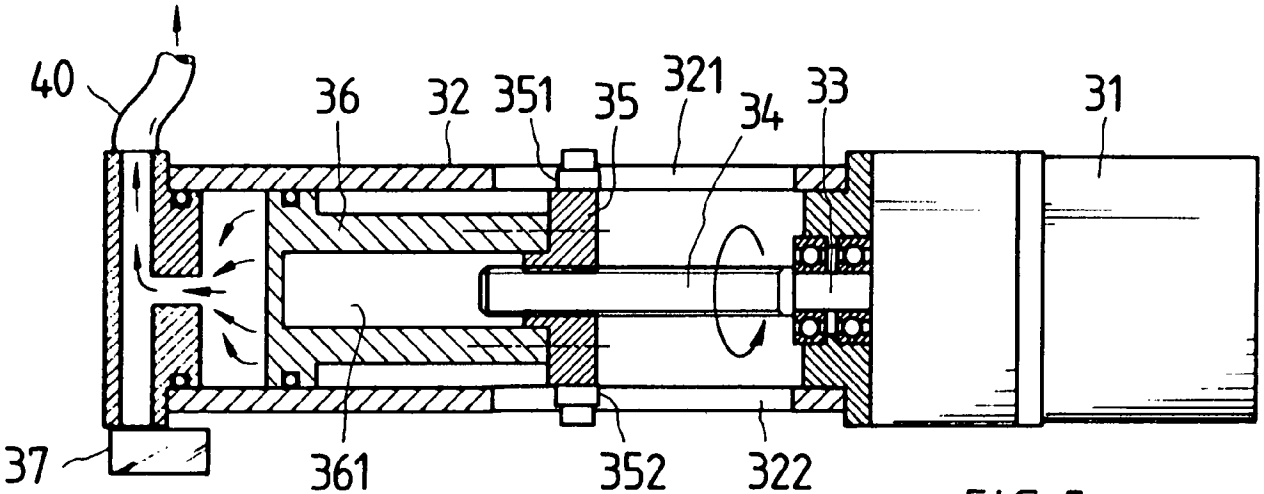
FIG, 5
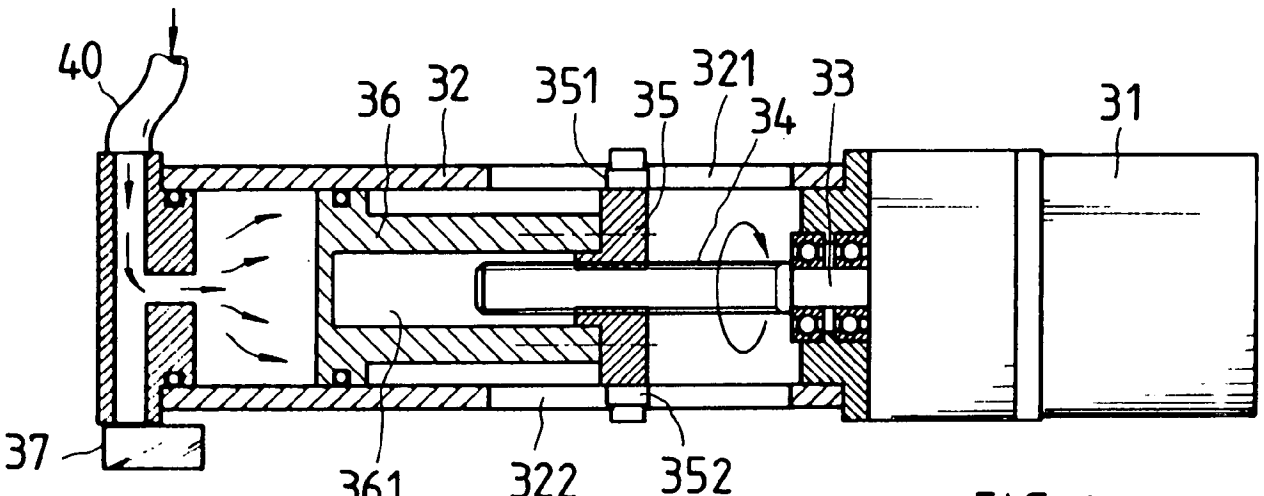
FIG, 6

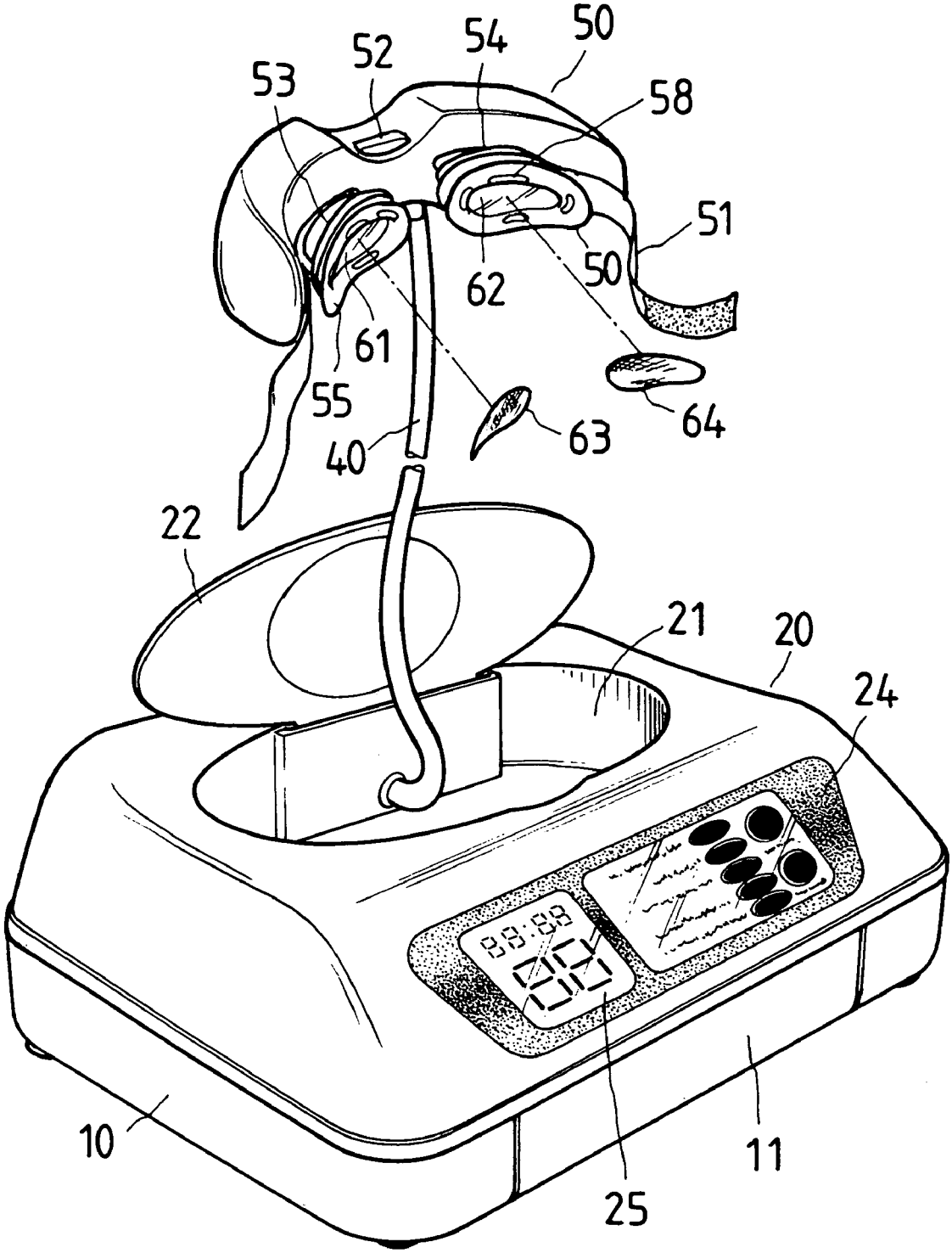
FIG,7

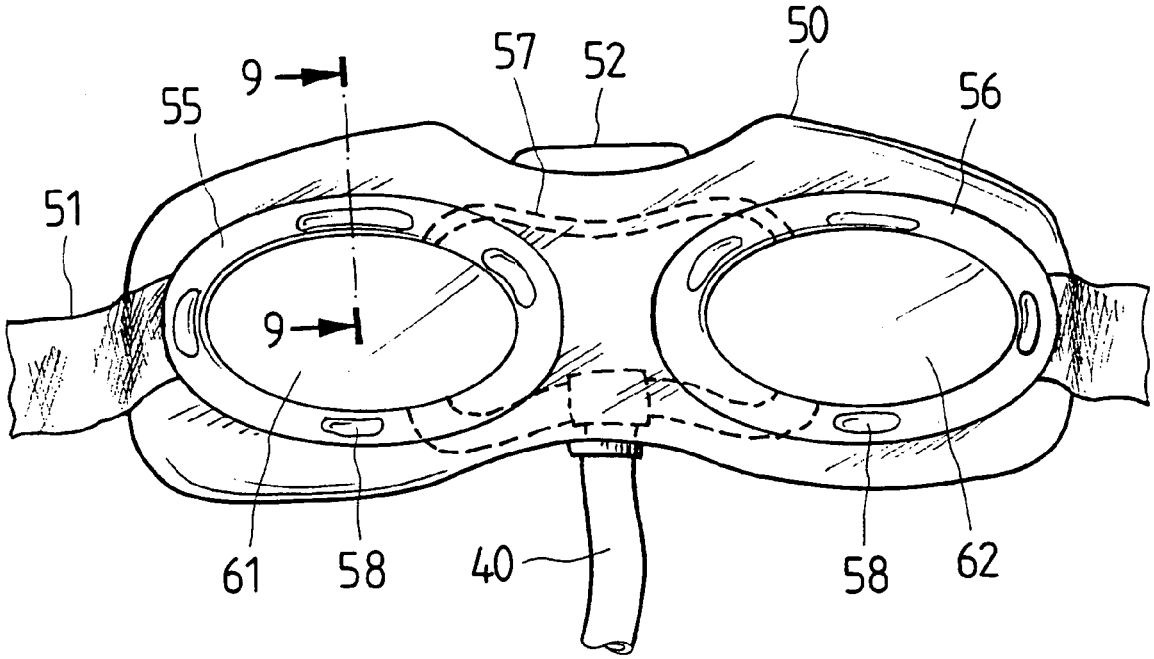
FIG, 8
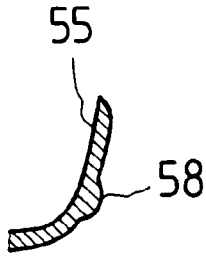
FIG, 9

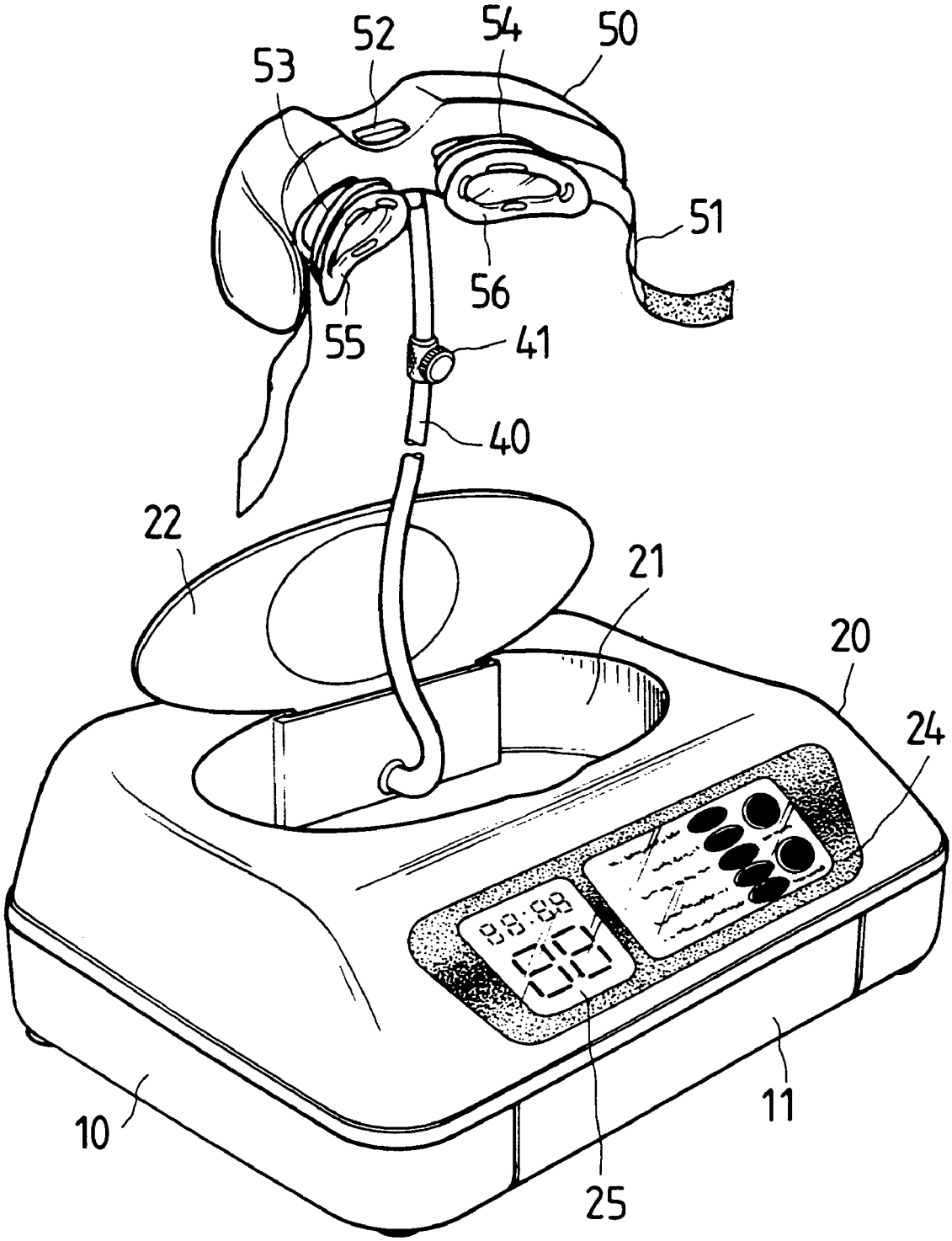
FIG,10

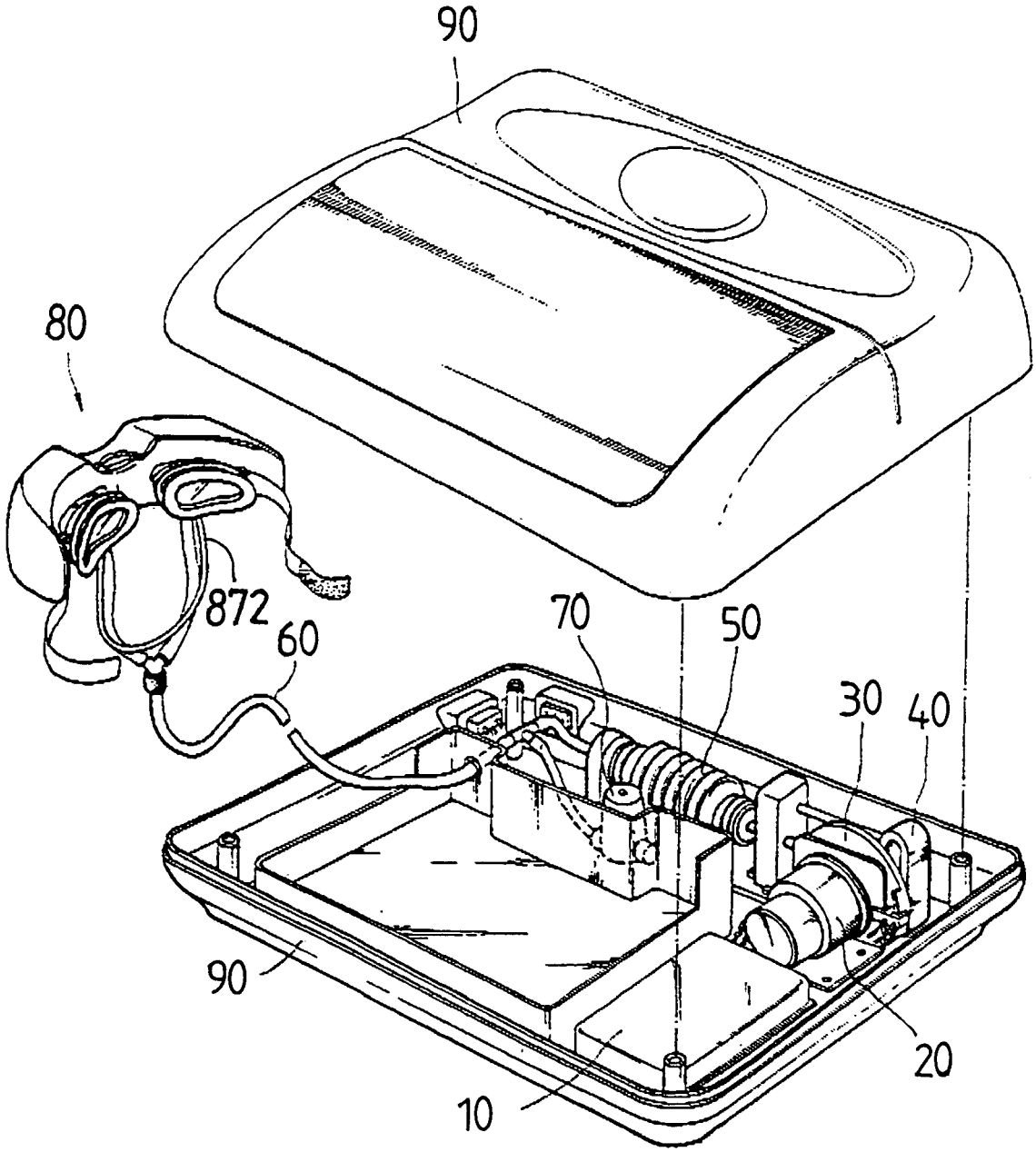
FIG, 11
PRIOR ART

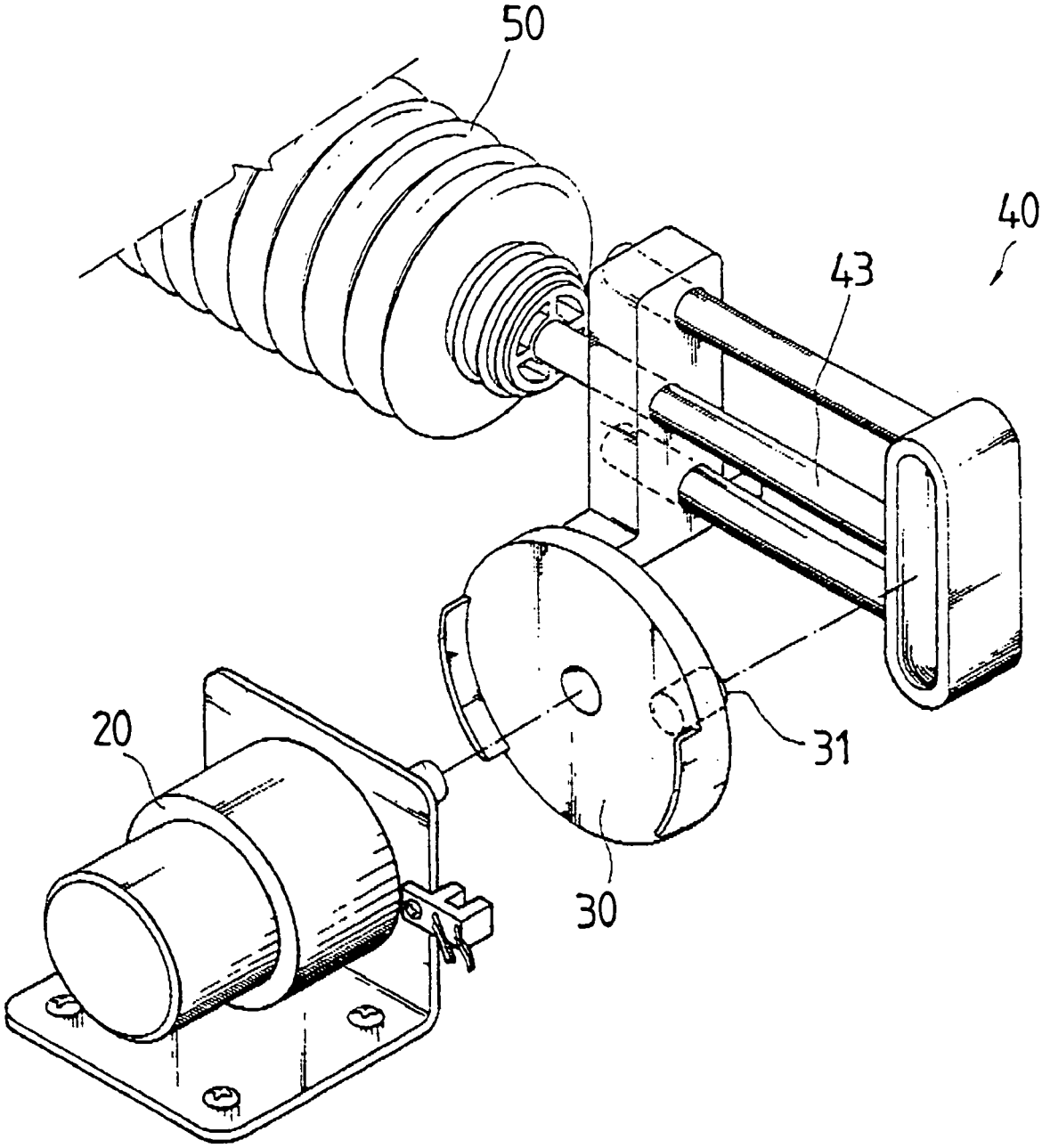
FIG, 12
PRIOR ART

EYES MASSAGE DEVICE

BACKGROUND OF THE INVENTION

1. Field of Invention

The present invention relates to massage equipment and more particularly to a device for massaging eyes for preventing eyesight of a person having astigmatism, long-sightedness, short-sightedness, or the like from further deteriorating.

2. Related Art

Eye defects such as astigmatism, long-sightedness, short-sightedness, or the like are often among people. It is known that a pair of spectacles having correcting lenses can be used to correct eyesight of a person having, for example short-sightedness. However, it is also often that a person wearing such spectacles still has his/her eyesight deteriorated. As a result, a more or less frequent change of spectacles is made. This can increase the financial burden borne upon the wearer. Hence, a need has arisen for a device for massaging eyes for preventing eyesight from further deteriorating.

A conventional eyes massage device is shown in FIGS. 11 and 12. The device is enclosed in a housing 90 and comprises a control unit 10, a motor 20, a disc 30 rotatably connected to the motor 20, an actuator 40, a bellows member 50, a plastic tube 60 having one end in fluid communication with the bellows member 50, a valve 70 at the tube 60, and a mask 80 at the other end of the tube 60 in which the disc 30 has a projecting rod 31 connected to one side of the actuator 40.

In operation, enables the control unit 10 to activate the motor 20 for rotating the disc 30. Rods 43 of the actuator 40 thus move back and forth to cause the bellows member 50 to reciprocate. Positive pressure air (i.e., pressurized air) and negative pressure air (i.e., substantially vacuum) are generated alternately in the bellows member 50 and are communicated to the mask 80 via the valve 70 and the tube 60. Two diaphragms in the mask 80 in close proximity with both eyes of a person are thus moved by the positive pressure air or the negative pressure air to massage the eyes. A telescopic member is formed between two eye portions of the mask 80 such that an interpupillary distance of the person can be adjusted for being adapted to different individuals. Moreover, a balance tubing 872 is formed between the eye portions of the mask 80 for balancing pressure between the eye portions of the mask 80.

However, the known device suffered from several disadvantages. For example, the coupling between the projecting rod 31 and the actuator 40 is a cam-based one. Thus, its components are relatively complicated and unbearable noise can be generated during operation. The diaphragms are in contact with eye balls during operation. Thus, the diaphragms may be contaminated by tears. This is not hygienic. Moreover, the balance tubing 872 is exposed, resulting in a detraction of the device's external appearance. Thus, the need for improvement still exists.

SUMMARY OF THE INVENTION

It is therefore an object of the present invention to provide a device for massaging eyes comprising a housing comprising a compartment, a lid hingedly connected to a top edge of the compartment, a control unit, and a display adjacent the control unit; a mask received in the compartment and enclosed by the lid in a nonoperating state, the mask comprising a pair of straps adapted to hold to the head of a person, left and right eye portions, a dial for adjusting a distance between the eye portions, annular left and right guards formed of flexible plastic material surrounding rear portions of the eye portions respectively, and left and right diaphragms in the eye portions respectively; a pneumatic-powered cylinder assembly comprising a cylinder, a step motor at one end of the cylinder, the step motor having a shaft, a rod having one end connected to the shaft, a bar having a central aperture slidably put on the rod opposing the shaft, a piston closely fitted in the cylinder and having one end fixedly connected to the bar, the piston having a lengthwise, central bore for permitting the rod to move therein, two opposite, elongated slots formed on a circumferential surface of the cylinder, and two opposite nuts fastened at both ends of the bar such that a movement of either end of the bar is defined between both ends of either slot; and a plastic tube interconnected the mask and the pneumatic-powered cylinder assembly; wherein in an operating state the shaft rotates in a first direction to cause both the bar and the piston to move forward for compressing air in the cylinder prior to arriving the mask via the tube in response to a first action of the step motor; the shaft rotates in a second opposite direction to cause both the bar and the piston to move rearward for drawing air from the eye portions of the mask via the tube by building pressure below atmospheric pressure in the cylinder in response to a next second action of the step motor; and the first and second actions of the step motor are performed alternately for changing air pressure in the mask from positive to negative alternately, thereby massaging the eyes.

In one aspect of the present invention, a valve is provided either at the other end of the cylinder or in the tube, the valve being adapted to release pressurized air in the cylinder.

In another aspect of the present invention, there are provided a plurality of protrusions around a rear portion of each of the guards.

In yet another aspect of the present invention, there are provided left and right layer-shaped, soft spacers attached to rear surfaces of the diaphragms respectively.

The above and other objects, features and advantages of the present invention will become apparent from the following detailed description taken with the accompanying drawings.

BRIEF DESCRIPTION OF THE DRAWINGS

FIGS. 5 and 6 are views similar to FIG. 4 showing air drawing and air giving off actions of the pneumatic-powered cylinder assembly respectively;

FIG. 7 is a perspective view of a second preferred embodiment of eyes massage device according to the invention;

FIG. 8 is a front view of the mask in FIG. 2;

FIG. 9 is a sectional view of the guard taken along line 9—9 in FIG. 8;

FIG. 10 is a perspective view of a third preferred embodiment of eyes massage device according to the invention;

FIG. 11 is an exploded perspective view of a conventional eyes massage device; and FIG. 12 is an exploded, perspective, enlarged view of a portion of the device in FIG. 11.

DETAILED DESCRIPTION OF THE INVENTION

Figure 1:
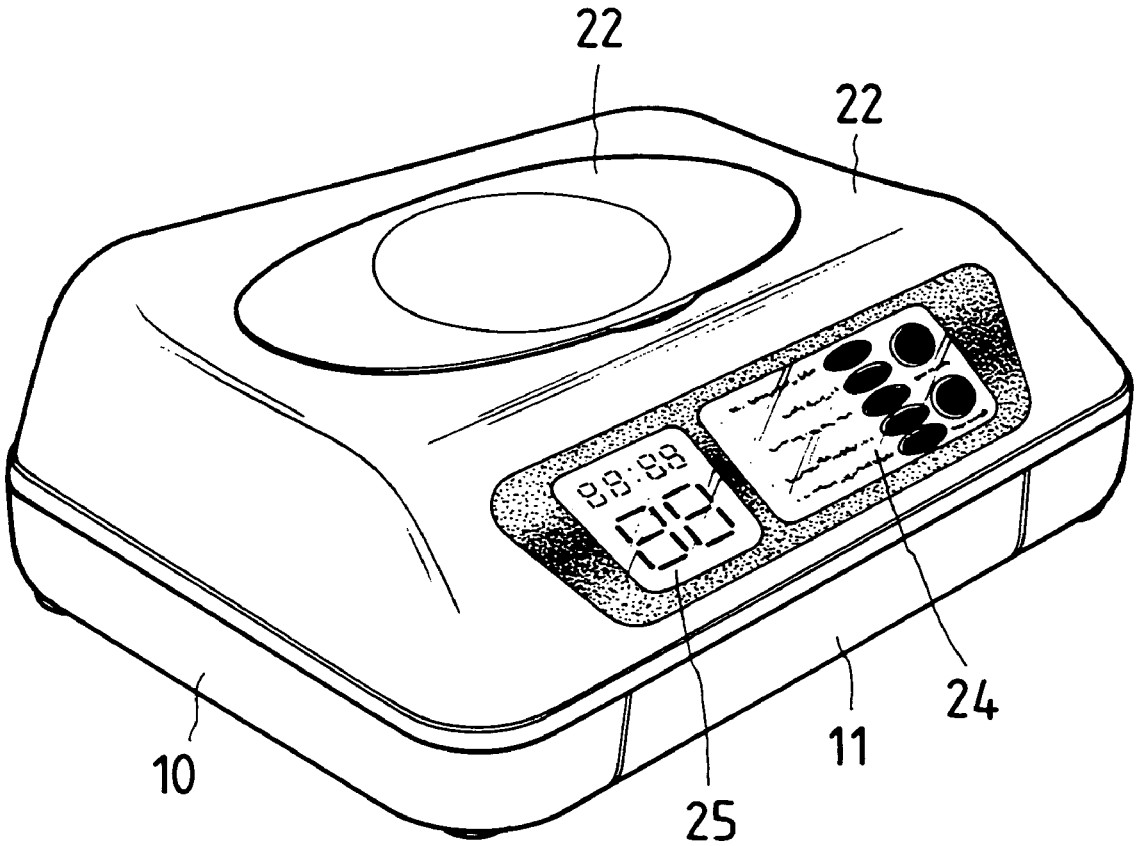
FIG. 1 is a perspective view of a first preferred embodiment of eyes massage device according to the invention.
Figure 2:
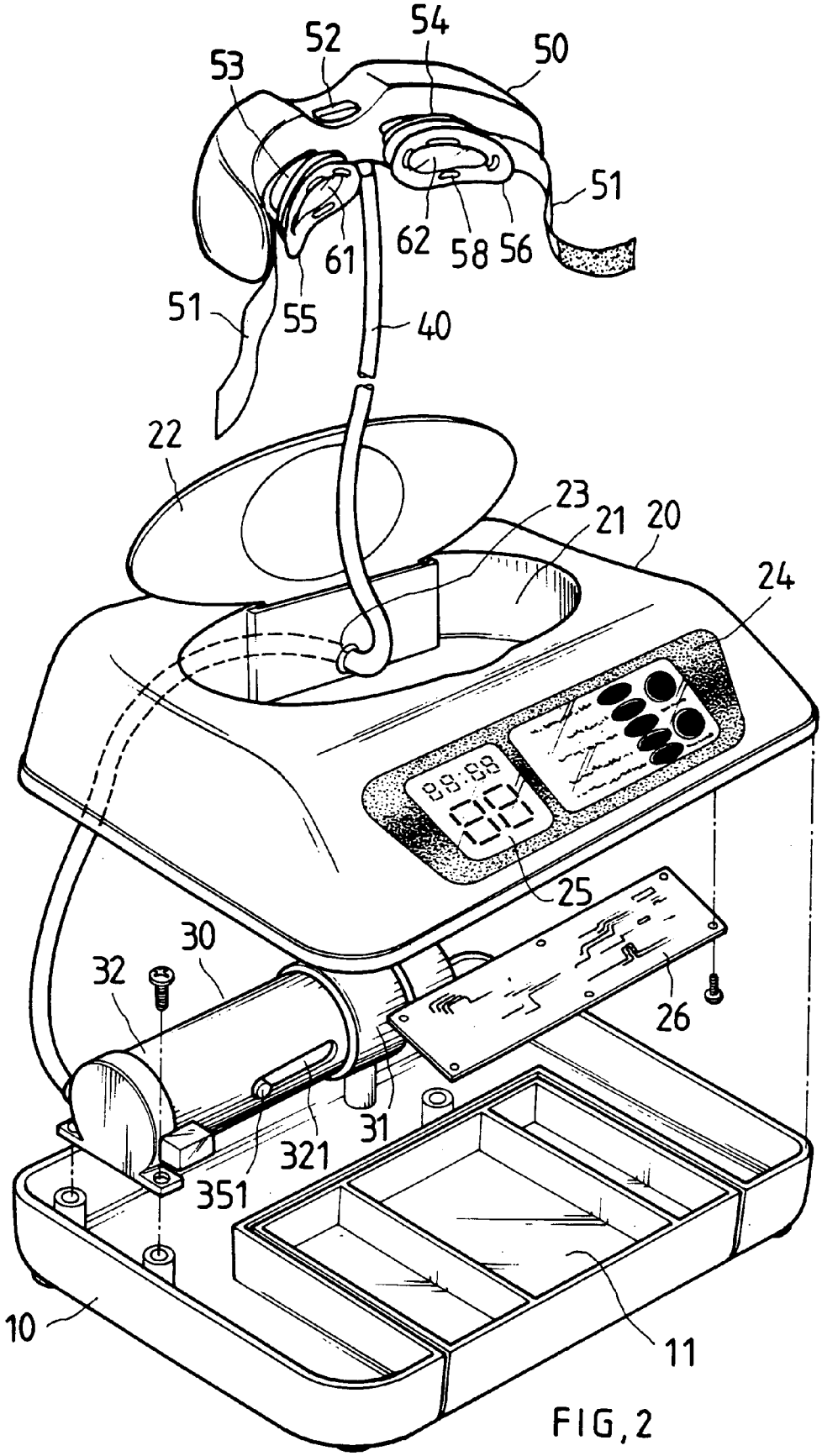
FIG. 2 is an exploded view of the device in FIG. 1.
Figure 3:
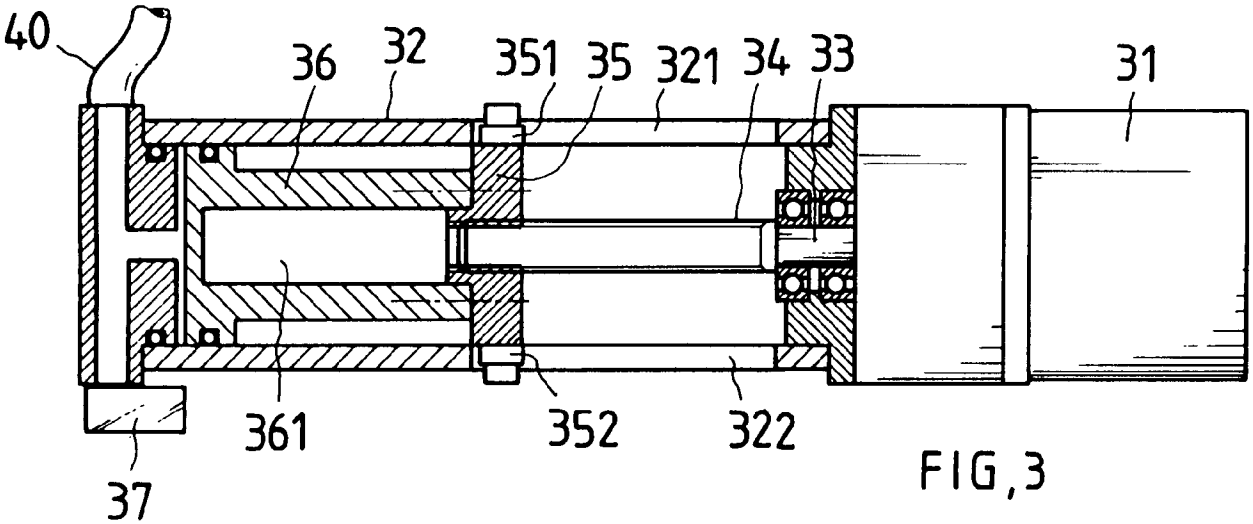
FIG. 3 is a vertical sectional view of the pneumatic-powered cylinder assembly in FIG. 1.
Figure 4:
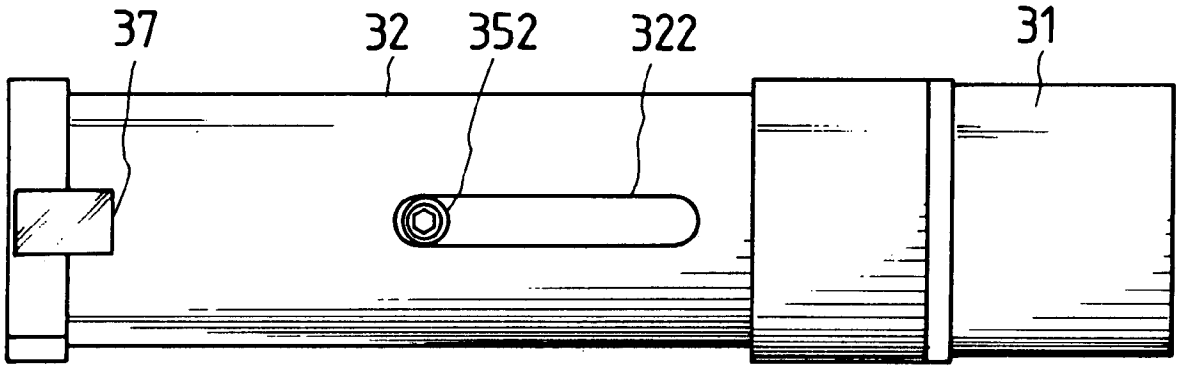
FIG. 4 is a side view of the pneumatic-powered cylinder assembly in FIG. 1.

Referring to FIGS. 1 to 4, there is shown a device for massaging eyes in accordance with a first preferred embodiment of the invention. The device comprises a base 10 and a mated cover 20. On the cover 20 there are provided a hinged top lid 22, a front control unit 24, and a liquid crystal display (LCD) 25 adjacent the control unit 24. In the base 20 there are provided a front drawer 11 having a plurality of compartments for storing objects, a circuit board 26 electrically connected to the control unit 24 and enabled thereby, a rear pneumatic-powered cylinder assembly 30, a mask 50 received in a top compartment 21 and enclosed by the lid 22 in a nonoperating state, and a plastic tube 40 interconnected the mask 50 and the pneumatic-powered cylinder assembly 30 by passing a hole 23 in a wall of the compartment 21. Prior to operation, modes of the pneumatic-powered cylinder assembly 30, operating time, and operating pressure can be set by pressing buttons on the control unit 24. Corresponding indications are then shown on the LCD 25.

The mask 50 comprises a pair of straps 51 adapted to hold to the head of a person. The person can adjust tightness of the straps 51. That is, the straps 51 are adapted to fit different individuals with different head sizes. The mask 50 further comprises a dial 52 for adjusting a distance between left and right eye portions 53 and 54 for being adapted to different individuals, and annular left and right guards 55 and 56 formed of flexible plastic material surrounding rear portions of the left and right eye portion 53 and 54 respectively. The guards 55 and 56 are adapted to sealingly engage with peripheral portions of the eyes. Moreover, left and right diaphragms 61 and 62 are formed in the left and right eye portions 53 and 54 respectively.

The pneumatic-powered cylinder assembly 30 comprises a cylinder 32, a step motor 31 provided at one end of the cylinder 32, a shaft 33 rotatably connected to the step motor 31, a rod 34 having one end connected to the shaft 33, a bar 35 having a central aperture slidably put on the rod 34 opposing the shaft 33, a piston 36 closely fitted in the cylinder 32 and having one end fixedly connected to the bar 35, the piston 36 having a lengthwise, central bore 361 for permitting the rod 34 to move therein during a massaging operation of the device as detailed later, two opposite, elongated slots 322 formed on a circumferential surface of the cylinder 32, and two opposite nuts 351 and 352 fastened at both ends of the bar 35 such that a movement of either nut 351 or 352 (i.e., the bar 35) is defined between both ends of the slot 321 or 322 during operation as detailed later.

Referring to FIGS. 5 and 6, a massaging operation of the device will be described in detailed below. In FIG. 5, the shaft 33 of the step motor 31 rotates in one direction (e.g., counterclockwise as shown) to cause the bar 35 and thus the piston 36 to move forward. Air in the cylinder 32 is thus compressed to give off to the tube 40 prior to arriving the mask 50. The pressurized air (i.e., positive pressure air) is adapted to massage the eyes of a person wearing the mask 50. To the contrary as shown in FIG. 6, the shaft 33 of the step motor 31 rotates in the other opposite direction (e.g., clockwise as shown) to cause the bar 35 and thus the piston 36 to move rearward. Air in the cylinder 32 is thus expanded to draw air from the tube 40 thereinto. As a result, negative pressure air (i.e., substantially vacuum) is created in the mask 50. As an end, the eyes are massaged. Such reciprocating motion of the piston 36 is precisely controlled by the clockwise and counterclockwise rotations of the step motor 31. After finishing the massaging operation, the user may open a valve 37 at the other end of the cylinder 32 to release pressurized air in the mask 50, the tube 40, and the cylinder 32. Noise generated by the step motor is much small in comparison with the known cam-based motor.

Referring to FIGS. 8 and 9, a plurality of protrusions 58 are formed around a rear portion of each of the guards 55 and 56. Positions of the protrusions 58 are substantially corresponding to massage points around the eyes. As such, an additional massaging effect on muscle around the eyes can be carried out when the eyes are being massaged. In short, the provision of the protrusions 58 is to enhance the eyes massaging effect.

Referring to FIG. 7, a device for massaging eyes in accordance with a second preferred embodiment of the invention is shown. The second preferred embodiment substantially has same structure as the first preferred embodiment. The difference between the first and the second preferred embodiments, i.e., the characteristic of the second preferred embodiment is detailed below. Left and right layer-shaped spacers 63 and 64 are attached to rear surfaces of the left and right diaphragms 61 and 62 respectively. The spacers 63 and 64 are formed of soft material (e.g., soft cloth or the like). The provision of spacers 63 and 64 aims at serving as buffer between the diaphragms 61 and 62 and the eyes and as means for absorbing tear secreted by the eyes during operation (i.e., the possibility of making the diaphragms 61 and 62 dirty is significantly reduced). In brief, a more comfortable and hygienic operation is effected.

Referring to FIG. 10, a device for massaging eyes in accordance with a third preferred embodiment of the invention is shown. The third preferred embodiment substantially has same structure as the first preferred embodiment. The difference between the first and the third preferred embodiments, i.e., the characteristic of the third preferred embodiment is detailed below. The valve 37 provided at the other end of the cylinder 32 is replaced by another valve 41 provided in the tube 40. After finishing the massaging operation, the user may open the valve 41 to release pressurized air in the mask 50, the tube 40, and the cylinder 32 without opening the cover 20. Thus, the massaging operation is facilitated.

While the invention herein disclosed has been described by means of specific embodiments, numerous modifications and variations could be made thereto by those skilled in the art without departing from the scope and spirit of the invention set forth in the claims.

What is claimed is:

1. A device for massaging eyes comprising:

a housing comprising a compartment, a lid hingedly connected to a top edge of the compartment, a control unit, and a display adjacent the control unit;

a mask received in the compartment and enclosed by the lid in a nonoperating state, the mask comprising a pair of straps adapted to hold to the head of a person, left and right eye portions, a dial for adjusting a distance between the eye portions, annular left and right guards formed of flexible plastic material surrounding rear portions of the eye portions respectively, and left and right diaphragms in the eye portions respectively;

a pneumatic-powered cylinder assembly comprising a cylinder, a step motor at one end of the cylinder, the step motor having a shaft, a rod having one end connected to the shaft, a bar having a central aperture slidably put on the rod opposing the shaft, a piston closely fitted in the cylinder and having one end fixedly connected to the bar, the piston having a lengthwise, central bore for permitting the rod to move therein, two opposite, elongated slots formed on a circumferential surface of the cylinder, and two opposite nuts fastened at both ends of the bar such that a movement of either end of the bar is defined between both ends of either slot; and a plastic tube interconnected the mask and the pneumatic-powered cylinder assembly;

wherein in an operating state the shaft rotates in a first direction to cause both the bar and the piston to move forward for compressing air in the cylinder prior to arriving the mask via the tube in response to a first action of the step motor; the shaft rotates in a second opposite direction to cause both the bar and the piston to move rearward for drawing air from the eye portions of the mask via the tube by building pressure below atmospheric pressure in the cylinder in response to a next second action of the step motor; and the first and second actions of the step motor are performed alternately for changing air pressure in the mask from positive to negative alternately, thereby massaging the eyes.

2. The device of claim 1, further comprising a valve at the other end of the cylinder, the valve being adapted to release pressurized air in the cylinder.

3. The device of claim 1, further comprising a plurality of protrusions around a rear portion of each of the guards.

4. The device of claim 1, further comprising left and right layer-shaped, soft spacers attached to rear surfaces of the diaphragms respectively.

5. The device of claim 1, further comprising a valve in the tube.

* * * * *